US010974540B1

(12) United States Patent
Yu

(10) Patent No.: US 10,974,540 B1
(45) Date of Patent: Apr. 13, 2021

(54) RETRACTABLE PEN WITH A PUSH BUTTON

(71) Applicant: Hangzhou Jianyi Technology Co., Ltd., Zhejiang (CN)

(72) Inventor: Chengpeng Yu, Zhejiang (CN)

(73) Assignee: Hangzhou Jianyi Technology Co., Ltd, Hangzhou (CN)

( * ) Notice: Subject to any disclaimer, the term of this patent is extended or adjusted under 35 U.S.C. 154(b) by 0 days.

(21) Appl. No.: 17/069,766

(22) Filed: Oct. 13, 2020

(30) Foreign Application Priority Data

Dec. 22, 2019 (CN) ..... 201911332749.5

(51) Int. Cl.
*B43K 24/08* (2006.01)
*B43K 7/12* (2006.01)
*B43K 7/00* (2006.01)

(52) U.S. Cl.
CPC ..... *B43K 24/082* (2013.01); *B43K 7/005* (2013.01); *B43K 7/12* (2013.01)

(58) Field of Classification Search
CPC . B43K 7/00; B43K 7/005; B43K 7/02; B43K 7/12; B43K 24/02; B43K 24/08; B43K 24/082; B43K 24/084
See application file for complete search history.

(56) References Cited

U.S. PATENT DOCUMENTS 2,400,679 A * 5/1946 Biro ..... B43K 24/08 401/106
2,536,923 A * 1/1951 Fehling ..... B43K 24/08 401/101
2,580,753 A * 1/1952 Frentzel ..... B43K 24/08 401/105
2,722,914 A * 11/1955 Aversa ..... B43K 24/08 401/105
3,146,758 A * 9/1964 Zepell ..... B43K 29/02 401/106
3,836,264 A * 9/1974 Saito ..... B43K 24/082 401/65
3,883,253 A * 5/1975 Naruse ..... B43K 24/082 401/65
3,902,815 A * 9/1975 Williams ..... B43L 19/0018 401/264
5,139,356 A * 8/1992 Shimada ..... B43K 21/22 401/65

(Continued)

FOREIGN PATENT DOCUMENTS

CN 201086501 Y 7/2008
CN 101797854 A 8/2010
CN 110341349 A 10/2019

*Primary Examiner* — Patrick M. Buechner

(57) ABSTRACT

A retractable pen with a push button includes a top plug, a barrel and a bottom holder. The top plug is partially insertable into the barrel and is axially movable with respect to the barrel, and the bottom holder is in threaded connection with the barrel. A refill is arranged in the top plug, the barrel and the bottom holder. A reset spring is arranged between the refill and the bottom holder. An end of the push button located in the barrel is provided with at least one clamping member configured to clamp the barrel and a push member configured to drive the top plug to axially slide with respect to the barrel. At least one limit piece is fixedly provided on an inner wall of the barrel to hold the clamping member.

10 Claims, 8 Drawing Sheets

(56) References Cited

U.S. PATENT DOCUMENTS

| | | | | | |
|---|---|---|---|---|---|
| 5,927,882 | A * | 7/1999 | Kageyama | A45D 40/04 | 401/52 |
| 5,967,684 | A * | 10/1999 | Huang | B43K 24/082 | 24/11 F |
| 5,971,644 | A * | 10/1999 | Kageyama | B43K 24/082 | 401/54 |
| 6,065,889 | A * | 5/2000 | Maruyama | B43K 24/082 | 401/65 |
| 2007/0231048 | A1* | 10/2007 | Rolion | B43K 21/027 | 401/85 |
| 2007/0243007 | A1* | 10/2007 | Chang | B43K 24/082 | 401/109 |
| 2014/0030004 | A1* | 1/2014 | Nakamura | B05C 17/00596 | 401/176 |
| 2015/0050062 | A1* | 2/2015 | Rolion | B43K 8/24 | 401/114 |
| 2019/0193455 | A1* | 6/2019 | Bez | B43K 29/00 | |

* cited by examiner

RETRACTABLE PEN WITH A PUSH BUTTON

CROSS-REFERENCE TO RELATED APPLICATIONS

This application claims the benefit of priority from Chinese Patent Application No. 201911332749.5, filed on Dec. 22, 2019. The content of the aforementioned applications, including any intervening amendments thereto, is incorporated herein by reference in its entirety.

TECHNICAL FIELD

The present application relates to writing instruments, more particularly to a retractable pen with a push button.

BACKGROUND

A pen is a commonly used writing instrument in our daily life. When studying or working, people are used to keeping a pen with them to write down what they have seen or heard in time. There are many types of pens, such as gel pen, fountain pen, pencil and brush pen.

A pen usually includes two parts: a barrel and a cap. However, when the cap is lost or damaged, no protection is afforded to a pen tip, and as a result the pen tip is more likely to be broken and the ink may leak out, so the pen is no longer suitable to carry around. For some existing retractable pens, when the pen is pressed by surroundings for example in a bag, the pen tip may protrude from the barrel and stain or stab the surroundings. In addition, when the press cap of the retractable pen is lost, the refill is no longer retractable and thus the pen becomes useless.

SUMMARY

To solve technical problems in the prior art, an object of the present application is to provide a retractable pen with a push button, which can protrude a refill outside a barrel by pressing a top plug or the push button and retract the refill into the barrel by pressing the push button according to the practical use. The retractable pen of the present application can provide a better protection for the pen tip and is portable. Apart from avoiding a use of an independent protective cap, the pen tip hardly extends outside a bottom holder under a small external force, so that the pen tip seldom stains or stabs the surroundings. Furthermore, compared to the prior art, the retractable pen with the push button provides multiple approaches to protrude the refill, that is, when the top plug is broken, the retractable pen is still protrusible by pressing the push button.

Technical solutions of the present application are described as follows.

The present application provides a retractable pen with a push button, comprising:

a top plug;

a barrel; and a bottom holder;

wherein the top plug is partially insertable into the barrel and is axially movable with respect to the barrel; the bottom holder is in threaded connection with the barrel; a refill is arranged in the top plug, the barrel and the bottom holder; and a reset spring is arranged between the refill and the bottom holder;

wherein the retractable pen further comprises the push button for controlling an axial sliding of the top plug with respect to the barrel; an outer wall of the barrel is fixedly provided with a raised shell having an opening, through which the push button is moveable toward and away from the barrel;

an end of the push button located in the barrel is provided with at least one clamping member configured to clamp the barrel and a push member configured to drive the top plug to axially slide with respect to the barrel;

at least one limit piece is fixedly provided on an inner wall of the barrel to clamp the clamping member;

a guide piece is fixedly provided at an end of the top plug located in the barrel to control a distance that the push button moves toward and away from the barrel; and the guide piece matches with the push member;

when the push button is pressed, the push member drives the guide piece and the top plug to move axially with respect to the barrel until the clamping member is away from the limit piece;

when the push button is released, the clamping member moves in the barrel, under an elastic force of the reset spring, such that the clamping member is above the limit piece, and the refill drives, under the elastic force of the reset spring, the top plug to move axially with respect to the barrel until the refill retracts into the barrel;

when the push button is pressed again, the push member drives the guide piece and the top plug to move axially with respect to the barrel until the clamping member and the limit piece are in a snap fit and the refill protrudes from the barrel; and when being pressed, the top plug moves downward axially with respect to the barrel such that the reset spring is in compression and the refill protrudes from the barrel, and then the push button moves toward the barrel until the clamping member and the limit piece are connected in a snap fit.

In some embodiments, the clamping member comprises at least one positioning block fixedly provided at a side wall of the push button; a first guide surface is provided on a top of a hook of the positioning block to engage with the limit piece, and a second guide surface is provided at a bottom of the hook. When it is required to retract the refill into the barrel, the push button is pressed toward the barrel, during which the first guide surface is gradually away from a clamping slope, meanwhile, the second guide surface slides down along a first slope, until the first guide surface is completely separated from the clamping slope. The push button is continuously pressed until the second guide surface is separated from the first slope. After the push button is released, the push button moves, under the elastic force of the reset spring, away from the barrel, until the second guide surface is in contact with the second slope In some embodiment, the limit piece includes a barb and the first slope; the barb is a combination of a second slope provided on the inner wall of the barrel and the clamping slope located under the second slope; the first slope is provided on the inner wall of the barrel, so the second guide surface is slidable along the first slope; the first slope is below the barb; and the barb is configured to connect the first guide surface in a snap fit. When the hook and the barb are in snap fit, the second guide surface abuts against the first slope and the refill protrudes from the barrel. In the process of pressing the push button, the second guide surface slides down along a surface of the first slope, and the push button is continuously pressed until the clamping member is separated from the limit piece, subsequently, the second guide surface abuts against the second slope.

In some embodiment, a gradient of the first slope is smaller than that of the second slope; the first slope and an end of the clamping slope are in the same vertical plane; and a cross-sectional area of the first slope is larger than that of the clamping slope. After the hook of the positioning block is separated from the barb by pressing the push button, a larger press force is required to apply on the push button to separate the second guide surface from the first slope, since the gradient of the second slope is larger than that of the first slope. Thus, when an external object accidentally presses the push button, the clamping member does not easily separate from the limit piece, which reduces a possibility that the clamping member separates from the limit piece by accident.

In some embodiment, the push member is fixedly provided on a top of an interior of the push button, and a cross section of the push member is of a triangular shape. In the process of pressing the push button, the push member pushes the guide piece and the top plug to move axially with respect to the barrel.

In some embodiment, the guide piece comprises a connecting plate and a guide block fixedly connected with each other; the connecting plate is fixedly connected to the end of the top plug located in the barrel; and the guide block matches with an inclined bottom of the push member facing the bottom holder. When the push button is pressed, the guide block moves under a driving force of the push member to drive the top plug to move axially with respect to the barrel, and then the top plug drives the refill to compress the reset spring.

In some embodiment, a distance between the guide block and an inner wall of the push button is not less than a sliding distance of the hook of the positioning block in the limit piece. Therefore, when the push button is pressed and the guide block moves downward in the barrel to approach the inner wall of the push button, the clamping member is separated from the limit piece, that is, the first guide surface is separated from the barb or the second guide surface is separated from the first slope.

In some embodiments, a skirt is fixedly provided at a bottom of the push button in the barrel; and the skirt is elliptical and made of an elastic material. The skirt is configured to limit the push button, so that in a process of retracting the refill, the push button is not easy to be ejected outside the raised shell under the elastic force of the reset spring. Furthermore, the elastic material of the skirt provides an elastic force. When the top plug is pressed to protrude the refill, the push member loses the support and the limit of the guide block, and the push button moves toward the barrel, under its own gravity force and the elastic force of the skirt, until the clamping member clamped and the limit piece are connected in snap fit.

In some embodiments, a sum of an elastic force of the skirt and a gravity force of the push button is smaller than the elastic force of the reset spring, so that after the push button is pressed to separate the clamping member from the limit piece, the push member moves away from the barrel along an inner wall of the raised shell under the elastic force of the reset spring.

In some embodiment, a plurality of limit posts spaced apart are fixedly provided on an inner wall of the top plug, and the limit posts are in contact with the refill to further limit the refill so that the refill is more firmly fixed in the top plug.

Compared to the prior art, the advantages of the present application are shown as follows.

1) In the present application, the refill can extend outside the barrel by pressing the top plug or the push button according to the practical use, and the refill can retract into the barrel by pressing the push button to better protect the pen tip and make the pen portable. Apart from avoiding a use of an independent protective cap, the pen tip hardly extends outside the bottom holder under a small external force, so that the pen tip seldom stains or stabs the surroundings. Furthermore, compared to the prior art, the retractable pen of the present application provides multiple approaches to protrude the refill, that is when the top plug is broken, the retractable pen is still protrusible by pressing the push button.

2) The clamping member comprises at least one positioning block fixedly provided at a side wall of the push button; a first guide surface is provided on a top of a hook of the positioning block to engage with the limit piece, and a second guide surface is provided at a bottom of the hook. When it is required to retract the refill into the barrel, the push button is pressed toward the barrel, during which the first guide surface is gradually away from a clamping slope, meanwhile, the second guide surface slides down along a first slope, until the first guide surface is completely separated from the clamping slope. The push button is continuously pressed until the second guide surface is separated from the first slope. After the push button is released, the push button moves, under the elastic force of the reset spring, away from the barrel, until the second guide surface is in contact with the second slope.

3) The limit piece includes a barb and the first slope; the barb is a combination of a second slope provided on the inner wall of the barrel and the clamping slope located under the second slope; the first slope is provided on the inner wall of the barrel, so the second guide surface is slidable along the first slope; the first slope is below the barb; and the barb is configured to connect the first guide surface in a snap fit. When the hook and the barb are in snap fit, the second guide surface abuts against the first slope and the refill protrudes from the barrel. In the process of pressing the push button, the second guide surface slides down along a surface of the first slope, and the push button is continuously pressed until the clamping member is separated from the limit piece, subsequently, the second guide surface abuts against the second slope.

4) A gradient of the first slope is smaller than that of the second slope; the first slope and an end of the clamping slope are in the same vertical plane; and a cross-sectional area of the first slope is larger than that of the clamping slope. After the hook of the positioning block is separated from the barb by pressing the push button, a larger press force is required to apply on the push button to separate the second guide surface from the first slope, since the gradient of the second slope is larger than that of the first slope. Thus, when an external object accidentally presses the push button, the clamping member does not easily separate from the limit piece, which reduces a possibility that the clamping member separates from the limit piece by accident.

5) The push member is fixedly provided on a top of an interior of the push button, and a cross section of the push member is of a triangular shape. In the process of pressing the push button, the push member pushes the guide piece and the top plug to move axially with respect to the barrel.

6) The guide piece comprises a connecting plate and a guide block fixedly connected with each other; the connecting plate is fixedly connected to the end of the top plug located in the barrel; and the guide block matches with an inclined bottom of the push member facing the bottom holder. When the push button is pressed, the guide block moves under a driving force of the push member to drive the top plug to move axially with respect to the barrel, and then the top plug drives the refill to compress the reset spring.

7) A distance between the guide block and an inner wall of the push button is not less than a sliding distance of the hook of the positioning block in the limit piece. Therefore, when the push button is pressed and the guide block moves downward in the barrel to approach the inner wall of the push button, the clamping member is separated from the limit piece, that is, the first guide surface is separated from the barb or the second guide surface is separated from the first slope.

8) A skirt is fixedly provided at a bottom of the push button in the barrel; and the skirt is elliptical and made of an elastic material. The skirt is configured to limit the push button, so that in a process of retracting the refill, the push button is not easy to be ejected outside the raised shell under the elastic force of the reset spring. Furthermore, the elastic material of the skirt provides an elastic force. When the top plug is pressed to protrude the refill, the push member loses the support and the limit of the guide block, and the push button moves toward the barrel, under its own gravity force and the elastic force of the skirt, until the clamping member and the limit piece are connected in snap fit.

9) A sum of an elastic force of the skirt and a gravity force of the push button is smaller than the elastic force of the reset spring, so that after the push button is pressed to separate the clamping member from the limit piece, the push member moves away from the barrel along an inner wall of the raised shell under the elastic force of the reset spring.

10) A plurality of limit posts spaced apart are fixedly provided on an inner wall of the top plug, and the limit posts are in contact with the refill to further limit the refill so that the refill is more firmly fixed in the top plug.

Figure 1:
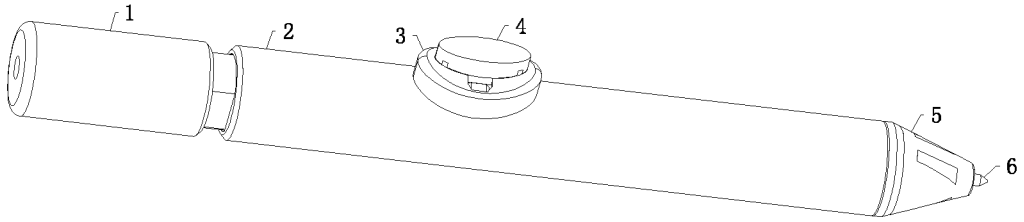
FIG. 1 is a perspective view of a retractable pen with a push button according to the present application.

In the drawings: 1, top plug; 2, barrel; 2*a*, first slope; 2*b*, clamping slope; 2*c*, second slope; 3, raised shell; 4, push button; 41, push member; 42, skirt; 43, second guide surface; 44, positioning block; 45, first guide surface; 5, bottom holder; 6, refill; 7, limit post; 8, guide piece; 81, connecting plate; and 82, guide block.

DETAILED DESCRIPTION OF EMBODIMENTS

The present application will be clearly and completely described in view of embodiments with reference to the accompanying drawings.

Figure 2:
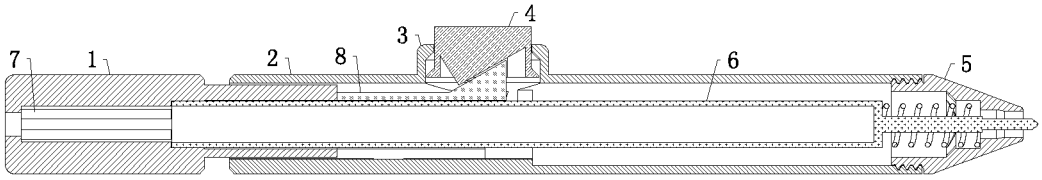
FIG. 2 is a cross-sectional view of the retractable pen with the push button according to the present application.
Figure 3:
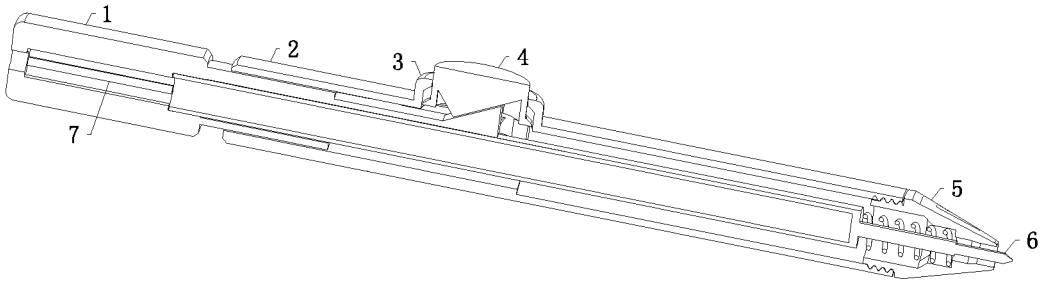
FIG. 3 is a cross-sectional and perspective view of the retractable pen with the push button according to the present application.
Figure 4:
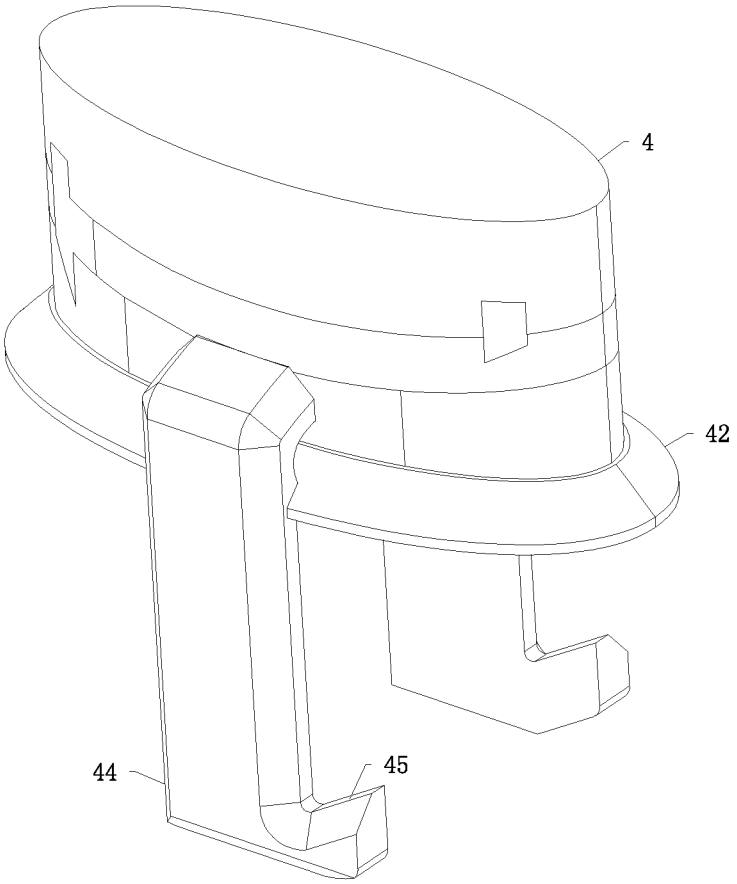
FIG. 4 is a perspective view of the push button according to the present application.
Figure 5:
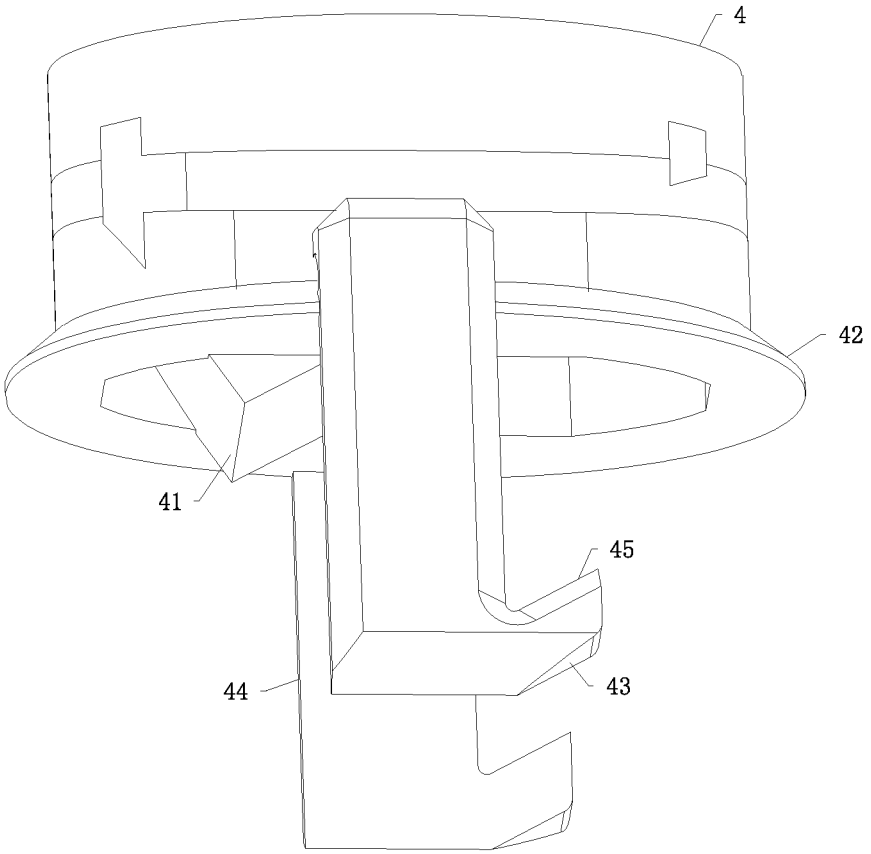
FIG. 5 is a bottom view of the push button according to the present application.
Figure 6:
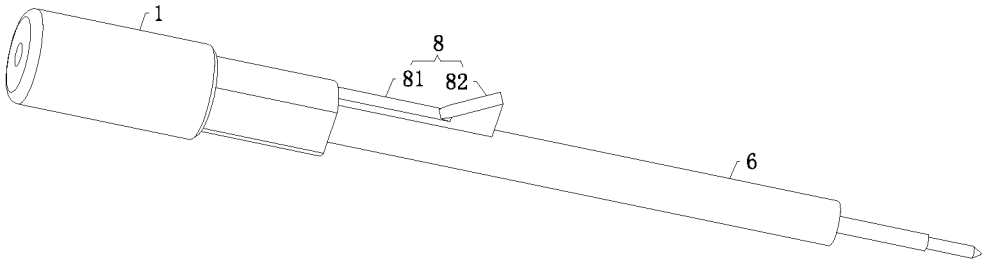
FIG. 6 is a schematic diagram of a top plug and a guide piece according to the present application.
Figure 7:
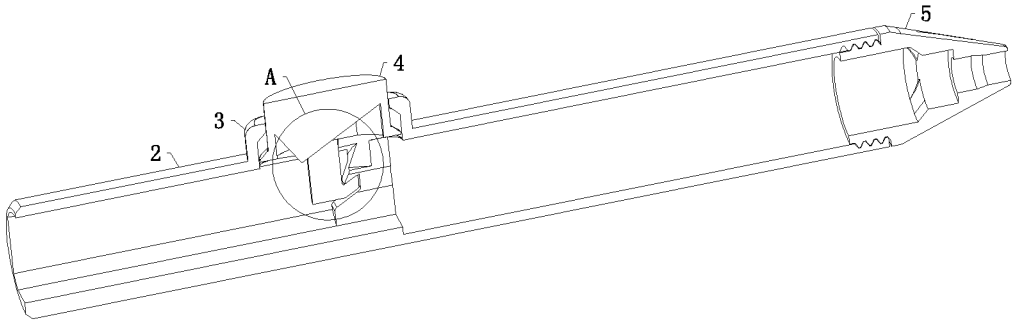
FIG. 7 is a cross-sectional view of a barrel and the push button when a pen tip is out of a bottom holder according to the present application.
Figure 8:
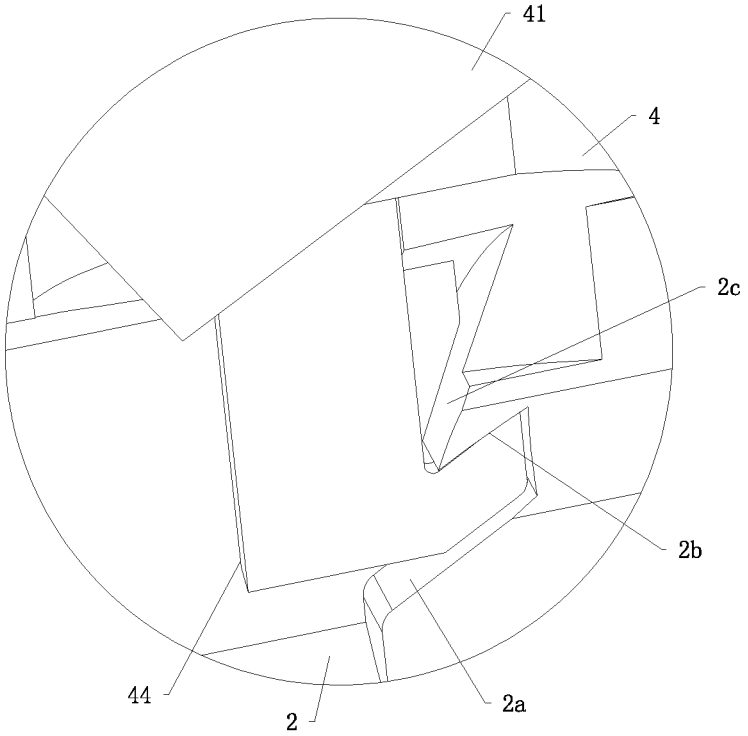
FIG. 8 is an enlarged schematic diagram of a portion marked as A of FIG. 7.

Referring to FIGS. 1-8, a retractable pen with a push button includes a top plug 1, a barrel 2 and a bottom holder 5. The top plug 1 is partially insertable into the barrel 2 and is axially movable with respect to the barrel 2. The bottom holder 5 is in threaded connection with the barrel 2. A refill 6 is arranged in the top plug 1, the barrel 2 and the bottom holder 5. A reset spring is arranged between the refill 6 and the bottom holder 7. A plurality of limit posts 7 spaced apart are fixedly provided on an inner wall of the top plug 1, and the limit posts are in contact with the refill 6 to further limit the refill 6 so that the refill 6 is more firmly fixed in the top plug 1.

The retractable pen further includes the push button 4 for controlling an axial sliding of the top plug 1 with respect to the barrel 2. An outer wall of the barrel 2 is fixedly provided with a raised shell 3 having an opening, through which the push button 4 is moveable toward and away from the barrel 2.

An end of the push button 4 located in the barrel 2 is provided with at least one clamping member configured to clamp the barrel 2 and a push member 41 configured to drive the top plug 1 to axially slide with respect to the bane 2. The push member 41 is fixedly provided on a top of an interior of the push button 4, and a cross section of the push member 41 is of a triangular shape. In the process of pressing the push button 4, the push member 41 pushes a guide piece 8 and the top plug 1 to move axially with respect to the barrel 2.

The clamping member includes at least one positioning block 44 fixedly provided at a side wall of the push button 4. A first guide surface 45 is provided on a top of a hook of the positioning block 44 to clamp a limit piece, and a second guide surface 43 is provided at a bottom of the hook. When it is required to retract the refill 6, the push button 4 is pressed toward the barrel 2, during which the first guide surface 45 is gradually away from a clamping slope 2*b*, meanwhile, the second guide surface 43 slides down along a first slope 2*a*, until the first guide surface 45 is completely separated from the clamping slope 2*b*. The push button 4 is continuously pressed until the second guide surface 42 is separated from the first slope 2*a*. After the push button 4 is released, the push button 4 moves, under the elastic force of the reset spring, away from the barrel, until the second guide surface 43 is in contact with the second slope 2*c*.

A skirt 42 is fixedly provided at a bottom of the push button 4 in the barrel 2, and the skirt 42 is elliptical and made of an elastic material. The skirt 42 is configured to limit the push button 4, so that in a process of retracting the refill 6, the push button 4 is not easy to be ejected outside the raised shell 3 under the elastic force of the reset spring. Furthermore. the elastic material of the skirt 42 can provide an elastic force. When the top plug 1 is pressed to protrude the refill 6, the push member 41 loses the support and the limit of a guide block 82, and the push button 4 moves toward the barrel, under its own gravity force and the elastic force of the skirt 42, until the clamping member and the limit piece are connected in snap fit. A sum of the elastic force of the skirt 42 and the gravity force of the push button 4 is smaller than the elastic force of the reset spring, so that after the push button 4 is pressed to separate the clamping member from the limit piece, the push member 41 can move away from the barrel along an inner wall of the raised shell 3 under the elastic force of the reset spring.

At least one limit piece is fixedly provided on an inner wall of the barrel 2 for clamping the clamping member. The limit piece includes a barb and the first slope 2*a*. The barb is a combination of the second slope 2*c* provided on the inner wall of the barrel 2 and the clamping slope 2*b* located under the second slope 2*c*. The first slope 2*a* is provided at the inner wall of the barrel 2, so the second guide surface 43 is slidable along the first slope. The first slope 2*a* is below the barb. The barb is configured to connect the first guide surface 45 in a snap fit. When the barb and a hook of the positioning block 44 are engaged together, the second guide surface 45 abuts against the first slope 2*a*, and the refill 6 protrudes. In the process of pressing the push button 4, the second guide surface 43 slides down along a surface of the first slope 2*a*, and the push button 4 is continuously pressed until the clamping member is separated from the limit piece, subsequently, the second guide surface 43 abuts against the second slope 2*c*.

A gradient of the first slope 2*a* is smaller than that of the second slope 2*c*. The first slope 2*a* and an end of the clamping slope 2*b* are in the same vertical plane. A cross-sectional area of the first slope 2*a* is larger than that of the clamping slope 2*b*. After the hook of the positioning block 4 is separated from the barb by pressing the push button 4, a larger press force is required to apply on the push button 4 to separate the second guide surface 43 from the first slope 2*a*, since the gradient of the second slope 2*c* is larger than that of the first slope 2*a*. Thus, when an external object accidentally presses the push button 4, the clamping member does not easily separate from the limit piece, which reduces a possibility that the clamping member separates from the limit piece by accident.

A guide piece 8 is fixedly provided at an end of the top plug 1 located in the barrel 2 to control a distance that the push button 4 moves toward and away from the barrel 2. The guide piece 8 matches with the push member 41. The guide piece 8 includes a connecting plate 81 and the guide block 82 fixedly connected with each other. The connecting plate 81 is fixedly connected to an end of the top plug 1 located in the barrel. The guide block 82 matches with an inclined bottom of the push member 41 facing the bottom holder. When the push button 4 is pressed, the guide block 82 moves under a driving force of the push member 41 to drive the top plug 1 to move axially with respect to the barrel 2, and then the top plug 1 drives the refill 6 to compress the reset spring 2. A distance between the guide block 82 and an inner wall of the push button 4 is not less than a sliding distance of the positioning block 44 in the limit piece. Therefore, when the push button 4 is pressed and the guide block 82 moves downward in the barrel 2 to approach the inner wall of the push button 4, the clamping member can be separated from the limit piece, that is, the first guide surface 45 is separated from the barb or the second guide surface 43 is separated from the first slope 2*a*.

In use, when it is required to retract the refill 6, the barrel 2 is hold by a user and the push button 4 is pressed down by the thumb of the user, and the push member 41 of the push button 4 drives the guide piece 8 and the top plug 1 to move axially with respect to the barrel 2, during which the clamping member of the push button 4 is gradually away from the limit piece, that is, the first guide surface 45 is gradually separated from the clamping slope 2*b*.

After the push button 4 is released, the clamping member moves in the barrel 2, under the elastic force of the reset spring, such that the clamping member is above the limit piece, that is, the second guide surface 43 is separated from the first slope 2*a* and then moves up to abut against the second slope 2*c*, and the refill 6 drives, under the elastic force of the reset spring, the top plug 1 to move axially with respect to the barrel 2 until the refill 6 retracts into the barrel 2.

In the case that the refill 6 protrudes by the way of pressing the push button 4, the push button 4 is pressed down and the push member 41 drives the guide piece 8 and the top plug 5 to move axially with respect to the barrel 2, until the clamping member and the limit piece are connected in a snap fit, that is, the hook of the positioning block 44 moves downward to engage the first guide surface 45 with the barb, at this time, the refill 6 protrudes from the barrel 2.

In the case that the refill 6 protrudes by the way of pressing the top plug 1, the top plug 1 is pressed down, the reset spring is in compression, and the refill 6 protrudes, at this time, the push button 4 moves toward a center of the barrel 2, under its own gravity force and the elastic force of the skirt 42, to engage the clamping member with the limit piece, that is, the first guide surface 45 and the barb are engaged in a snap fit, and the second guide surface 43 abuts against the first slope 2*a*.

In the present application, the refill 6 can extend outside the barrel 2 by pressing the top plug 1 or the push button 4 according to the practical use, and the refill 6 can retract into the barrel by pressing the push button 4 to better protect the pen tip and make the pen portable. Apart from avoiding a use of an independent protective cap, the pen tip hardly extends outside the bottom holder 5 under a small external force, so that the pen tip seldom stains or stabs the surroundings. Furthermore, compared to the prior art, the retractable pen of the present application provides multiple approaches to protrude the refill 6, that is when the top plug 1 is broken, the retractable pen is still protrusible by pressing the push button 4.

What is claimed is:

1. A retractable pen with a push button, comprising:

a top plug;

a barrel; and a bottom holder;

wherein the top plug is partially insertable into the barrel and is axially movable with respect to the barrel; the bottom holder is in threaded connection with the barrel; a refill is arranged in the top plug, the barrel and the bottom holder; and a reset spring is arranged between the refill and the bottom holder;

wherein the retractable pen further comprises the push button for controlling an axial sliding of the top plug with respect to the barrel; an outer wall of the barrel is fixedly provided with a raised shell having an opening, through which the push button is moveable toward and away from the barrel;

an end of the push button located in the barrel is provided with at least one clamping member configured to clamp the barrel and a push member configured to drive the top plug to axially slide with respect to the barrel;

at least one limit piece is fixedly provided on an inner wall of the barrel to clamp the clamping member;

a guide piece is fixedly provided at an end of the top plug located in the barrel to control a distance that the push button moves toward and away from the barrel; and the guide piece matches with the push member;

when the push button is pressed, the push member drives the guide piece and the top plug to move axially with respect to the barrel until the clamping member is away from the limit piece;

when the push button is released, the clamping member moves in the barrel, under an elastic force of the reset spring, such that the clamping member is above the limit piece, and the refill drives, under the elastic force of the reset spring, the top plug to move axially with respect to the barrel until the refill retracts into the barrel;

when the push button is pressed again, the push member drives the guide piece and the top plug to move axially with respect to the barrel until the clamping member and the limit piece are in a snap fit and the refill protrudes from the barrel; and when being pressed, the top plug moves downward axially with respect to the barrel such that the reset spring is in compression and the refill protrudes from the barrel, and then the push button moves toward the barrel until the clamping member and the limit piece are connected in a snap fit.

2. The retractable pen of claim 1, wherein the clamping member comprises at least one positioning block fixedly provided at a side wall of the push button; a first guide surface is provided on a top of a hook of the positioning block to engage with the limit piece, and a second guide surface is provided at a bottom of the hook.

3. The retractable pen of claim 2, wherein the limit piece comprises a barb and a first slope; the barb is a combination of a second slope provided on an inner wall of the barrel and a clamping slope located under the second slope; the first slope is provided on the inner wall of the barrel such that the second guide surface is slidable along the first slope; the first slope is below the barb; and the barb is configured to connect the first guide surface in a snap fit.

4. The retractable pen of claim 3, wherein a gradient of the first slope is smaller than that of the second slope; the first slope and an end of the clamping slope are in the same vertical plane; and a cross-sectional area of the first slope is larger than that of the clamping slope.

5. The retractable pen of claim 2, wherein the push member is fixedly provided on a top of an interior of the push button, and a cross section of the push member is of a triangular shape.

6. The retractable pen of claim 5, wherein the guide piece comprises a connecting plate and a guide block fixedly connected with each other; the connecting plate is fixedly connected to the end of the top plug located in the barrel; and the guide block matches with an inclined bottom of the push member facing the bottom holder.

7. The retractable pen of claim 6, wherein a distance between the guide block and an inner wall of the push button is not less than a sliding distance of the hook of the positioning block in the limit piece.

8. The retractable pen of claim 1, wherein a skirt is fixedly provided at a bottom of the push button in the barrel; and the skirt is elliptical and made of an elastic material.

9. The retractable pen of claim 8, wherein a sum of an elastic force of the skirt and a gravity force of the push button is smaller than the elastic force of the reset spring.

10. The retractable pen of claim 1, wherein a plurality of limit posts spaced apart are fixedly provided on an inner wall of the top plug, and the limit posts are in contact with the refill.

* * * * *